US006293392B1

(12) United States Patent
Galbierz

(10) Patent No.: US 6,293,392 B1
(45) Date of Patent: Sep. 25, 2001

(54) BEVERAGE CONTAINER CARRIER

(75) Inventor: Michael A. Galbierz, St. Louis, MO (US)

(73) Assignee: Eco-Pak Products, Inc., Fenton, MO (US)

( * ) Notice: Subject to any disclaimer, the term of this patent is extended or adjusted under 35 U.S.C. 154(b) by 0 days.

(21) Appl. No.: 09/535,318

(22) Filed: Mar. 27, 2000

(51) Int. Cl.[7] ..... B65D 75/00

(52) U.S. Cl. ..... 206/148; 206/153; 206/161; 206/427

(58) Field of Search ..... 206/149, 147, 206/148, 151, 152, 153, 158, 161, 199, 200, 427

(56) References Cited

U.S. PATENT DOCUMENTS

| | | | | |
|---|---|---|---|---|
| 3,601,439 | | 8/1971 | Poupitch . | |
| 4,190,149 | * | 2/1980 | Oliff et al. | 206/145 |
| 4,401,212 | | 8/1983 | Fischer . | |
| 4,491,223 | * | 1/1985 | Oliff | 206/434 |
| 4,736,977 | | 4/1988 | Killy . | |
| 5,186,321 | | 2/1993 | Fadus . | |
| 5,323,895 | * | 6/1994 | Sutherland et al. | 206/147 |
| 5,474,172 | * | 12/1995 | Zavatone et al. | 206/158 |
| 5,487,463 | * | 1/1996 | Harris | 206/145 |
| 5,551,566 | * | 9/1996 | Sutherland | 206/427 |
| 5,706,936 | * | 1/1998 | Bernstein | 206/147 |
| 5,711,419 | * | 1/1998 | Beales et al. | 206/148 |
| 6,059,099 | * | 5/2000 | Galbierz | 206/151 |

FOREIGN PATENT DOCUMENTS

| | | |
|---|---|---|
| 2363493 | 3/1978 | (FR) . |
| 2085391 | 5/1984 | (GB) . |

* cited by examiner

*Primary Examiner*—Shian Luong
(74) *Attorney, Agent, or Firm*—Polstar, Lieder, Woodruff & Lucchesi

(57) ABSTRACT

A reinforced planar carrier is provided which can carry, for example, four 2-liter bottles, without significantly bending. The carrier is made from a one piece paperboard blank having a machine direction. It has a center line, a pair of side edges, and a pair of end edges. The carrier includes a top ply and a bottom ply joined together along a hinge line which extends generally perpendicularly to the machine direction of the paperboard and defines one of said carrier's end edges. Finger holes are formed on opposite sides of the carrier centerline, approximately midway between the end edges of the carrier. The finger holes are positioned such that the carrier is lifted at points near the load. The finger holes are elongate. A tab from the top ply finger hole extends through the bottom ply finger hole when the carrier is lifted to define a rib extending generally parallel to the machine direction of the paperboard. Additionally, the carrier includes side flaps and an end flap which are hingedly connected to one of the top and bottom plies; and adhered to the other of the top and bottom plies.

14 Claims, 4 Drawing Sheets

BEVERAGE CONTAINER CARRIER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This application relates to beverage container carriers, and in particular to a planar carrier for use in conjunction with heavy and large (i.e., 2- and 3-liter) glass or plastic bottles, such as soda bottles.

Beverage bottlers, such as bottlers of Coke®, Pepsi®, 7-Up® and the like generally deliver beverage bottles to grocery stores in trays. These trays of bottles are then stacked one-on-top of the other, and consumers remove the bottles from the tray for purchase. The bottles are often grouped together in multi-pack carriers, such as four-packs, six-packs and the like.

There are numerous types of multi-pack carriers which fall into three categories: (1) basket-type carriers, (2) box-top or sleeve carriers, and (3) planar carriers. For instances such as noted above, basket-type carriers are not useable. Additionally, they are complex and required complex folding and gluing machinery to covert a blank to a basket carrier. Box-top or sleeve carriers are much easier to fold from a blank and are much less expensive to produce than basket carriers. However, planar carriers use even less material than box-top carriers, and thus are less expensive to manufacture than box-top carriers. It would be desirable to provide a planar carrier which has high planar strength so that it can be used to handle multi-packs of large, heavy bottles.

BRIEF SUMMARY OF THE INVENTION

Briefly stated, a reinforced planar carrier is provided. The carrier as shown in the drawings is a four-pack, but the invention should work equally well for two-packs and six-packs, etc. The reinforcements for the carrier, as described below, allow for a planar carrier to carry, for example, four 2-liter bottles, without significantly bending. Thus, the carrier has a high degree of planar rigidity across both its axes.

The carrier is made from a one piece paperboard blank having a machine direction. It has a center line, a pair of side edges, and a pair of end edges. The carrier includes a top ply and a bottom ply joined together along a hinge line which extends generally perpendicularly to the machine direction of the paperboard and defines one of the carrier's end edges. The top ply and bottom ply each include a plurality of aligned container receiving apertures formed in a 2×n array, such that there are two columns of container receiving apertures. A plurality of slits extending radially from each aperture in at least one of (and preferably in both of) the top and bottom plies define container engaging tabs to support a container in the carrier when the carrier is lifted.

Finger holes are formed on opposite sides of the carrier centerline, approximately midway between the end edges of the carrier. The finger holes are elongate. The bottom ply finger hole is simply an elongate opening formed in the bottom ply. The finger hole in the top ply has a tab sized and shaped to extend down through the bottom ply finger hole when the carrier is lifted. Both the top and bottom ply finger holes have an elongate edge which extends generally parallel to the machine direction of the carrier. Thus, when the carrier is lifted, the finger hole tabs form a supporting rib by extending through the bottom ply finger hole.

The container receiving apertures are outboard of the center line of the carrier. Additionally, the finger holes are positioned such that a line extending from the radially outer ends of the tab defining slits pass through the finger holes. Thus, when the carrier is lifted, the lifting is done at a point close to the load. This will minimize bending of the carrier about the centerline of the carrier when the carrier (with bottles) is lifted.

To additionally reinforce the planar strength of the carrier, the carrier includes side flaps extending along at least a portion of the carrier side edges. The side flaps are hingedly connected to one of the top and bottom plies; and adhered to the other of the top and bottom plies. The side flaps extend generally parallel to the machine direction of the paperboard. There is also an end flap which extends along the end edge of the carrier opposite the hinge line. The end flap is hingedly connected to one of the top and bottom plies and adhered to the other of the top and bottom plies. The end flap extends generally perpendicularly to the machine direction of the paperboard.

In one embodiment of the carrier, the tab defining slits are simply straight slits extending from the apertures in the two plies. In an alternative embodiment, the tab defining slits include a first slit extending radially from the apertures and a second slit extending from an outer end of the first slit. Thus, the tab defining slits are L-shaped or T-shaped.

In another modification to the carrier, the base of the top ply tabs defines a circle greater in diameter than the circle defined by the bottom ply tabs. Thus, when a container is received in the carrier, the top and bottom ply tabs define, in conjunction with the plane of the carrier, a triangle, the strongest geometric shape. The top ply tabs can engage the bottom ply tabs between the base and inner ends of the bottom ply tabs, or substantially at the inner ends of the bottom ply tabs. The top and bottom ply tabs can be of equal lengths, such that the top ply aperture is larger in diameter than the bottom ply aperture.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 2:
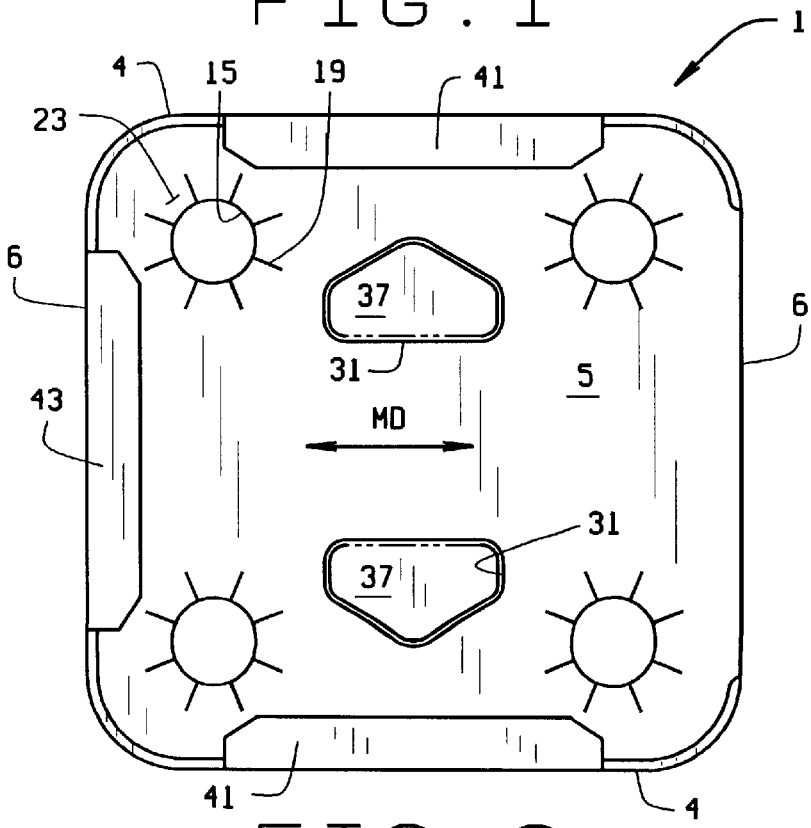
FIG. 2 is a bottom plan view of the carrier.
Figure 3:
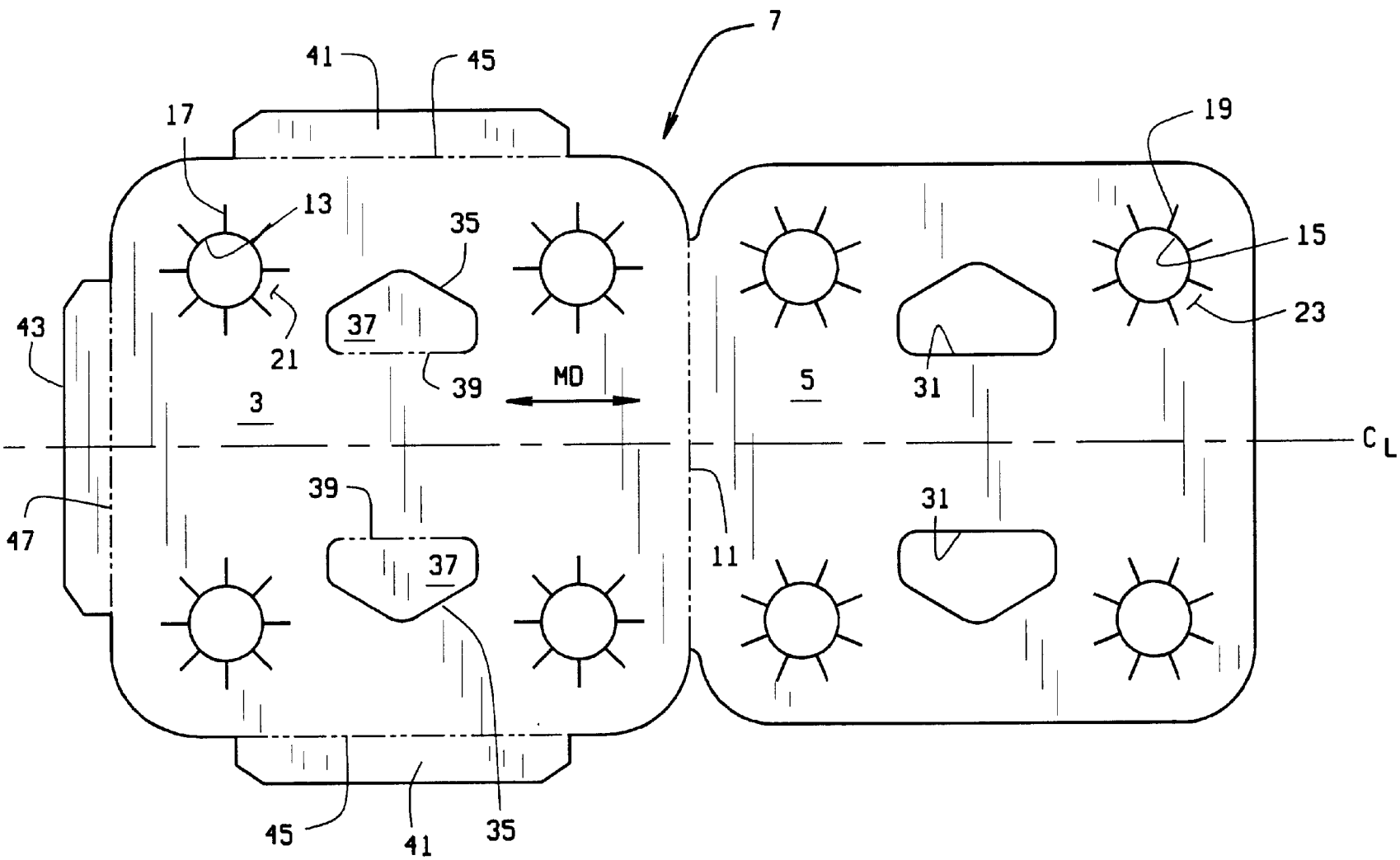
FIG. 3 is a top plan view of the blank from which the carrier is made.

The following detailed description illustrates the invention by way of example and not by way of limitation. This description will clearly enable one skilled in the art to make and use the invention, and describes several embodiments, adaptations, variations, alternatives and uses of the invention, including what I presently believe to be the best mode of carrying out the invention. A carrier 1 of the present invention is shown generally in FIGS. 1 and 2. The carrier 1 is a two-ply planar carrier having a top ply 3 and a bottom ply 5, side edges 4 and end edges 6. The carrier is formed from a one-piece blank 7 shown in FIG. 3, and the top and bottom plies 3 and 5 are joined together along a hinge line 11. The top and bottom ply each include a plurality of aligned apertures 13 and 15, respectively. Four apertures 13 and 15 are shown in the carrier to form a four-pack. However, more or fewer apertures could be provided for if desired. A plurality of slits 17 and 19 radiate from the top ply and bottom ply apertures 13 and 15, respectively to define a plurality of tabs 21 and 23 around the apertures. Eight tabs are shown to be provided around each aperture. However, the optimal number of tabs depends on the size of the aperture itself and the weight of the container to be carried by the carrier. The appropriate number of apertures can be derived at without undue experimentation by one skilled in designing bottle carriers. Preferably, the lower ply tabs 23 are offset from the upper ply tabs 21, such that the lower ply slits 19 are beneath the upper ply tabs 21 (and preferably bisect the upper ply tabs 21). As discussed in my U.S. Pat. No. 6,059,099, which is incorporated herein by reference, this offsetting of the top and bottom ply tabs increases the grip of the tabs on the containers when the carrier is loaded. The slits preferably have a length of about ⅜" to about ¼". The apertures 13 and 15 are outwardly of the center line CL of the carrier. This places the load closer to the edges of the carrier, where, as discussed below, the carrier's planar rigidity is reinforced. As shown in the drawings, the aperture centers are positioned to be about ½ to about ⅔ of the way between the carrier centerline CL and the carrier side edge 4. The spacing of the aperture centers from the centerline may vary depending on bottle size and the dimensions of the carrier.

A pair of finger holes 31 are formed in the bottom ply 5. The finger holes 31 are spaced equidistantly from the centerline CL and are shown to be mirror images of each other. The finger holes 31 are shown to be generally trapezoidal in shape, with their elongate bases being the edge closest to the centerline of the carrier.

A pair of finger holes 35 are also formed in the top ply. The top ply finger holes are the same shape and substantially the same size as the bottom ply finger holes 31, and are aligned with the bottom ply finger holes. The finger holes 35, however, retain the tab 37. The tab 37 is hingedly connected to the top ply 3 along a hinge line 39 at the base of the finger hole 35. The finger holes 35 are aligned with the finger holes 31; are substantially the same shape as the finger holes 31; and are sized, so that when carrier is lifted with bottles therein, the tab 37 will extend down through the finger holes 31. When the tab 37 is pushed down through the bottom ply finger hole 31, the tab 37 will extend downwardly and substantially parallel to the machine direction of the paperboard from which the carrier is made. The machine direction of the paperboard is denoted by the arrow MD in FIGS. 2 and 3.

The finger holes 31 and 35 are positioned so that their bases are between the outer ends of the inwardly directed slits 17*a* (FIG. 1) the center line CL of the carrier. With the finger holes shaped as trapezoids, as shown in the Figures, the apex 36 of the trapezoidal finger holes are aligned approximately with the centers of the apertures 13 and 15. The outboard corners 38 of the finger holes are approximately aligned with the inner most point of the top and bottom panel apertures. The finger holes are positioned to be at least partially in line with the top and bottom ply apertures. Thus, an imaginary line extending between the outer ends of the slits 17*a* which are perpendicular to the carrier centerline CL will pass through the finger holes 31 and 35. This places the finger holes substantially adjacent the load to be carried, and, when a loaded carrier is lifted, the person lifting the carrier will have his or her fingers generally in line with the load. By having the carrier lifted at a point that is adjacent the load, the bending of the carrier due to the distance between the lifting point of the carrier and the load will be reduced.

For example, in one preferred configuration, the bottle receiving apertures are spaced apart by approximately 4.7" on center. When 2-liter bottles are inserted in the carrier, this spacing places a gap between the bottles. This gap is necessary to span dividers which are part of special trays used by the Coca-Cola company and its bottlers. The trays used by the bottlers of other beverages may not have such a spacing between the bottles, or the spacing between the bottles may be greater or smaller than the spacing between the bottles in the Coca-Cola trays. Thus, the center-to-center spacing of the apertures can be changed as necessary to fit the trays for particular beverage bottlers. The center-to-center spacing can also reduced to eliminate the gap between bottles, such that the bottles are in contact with each other when in the carrier. As noted above, for a 2-liter soda bottle, the apertures preferably have a diameter of about 1" and the tab defining slits preferably are about 0.3" long.

For a carrier which is about 7.5" wide (between the carrier's side edges 4), the center of the apertures is about 1.5" from the side edge and about 2.4" from the centerline CL. Thus, the aperture centers are positioned approximately 60% of the distance from the centerline to the side edge. The outer most point of the aperture is about 1" from the carrier side edge; and the outer end of the slit 17*b* that is perpendicular to the edge is about 0.7" from the side slit. The outer end of the opposite slit 17*a*, which is closest to the centerline CL, is about 1.7" from the centerline. Because the carrier shown is generally square, the spacing of the apertures and slits from the end edges 6 is substantially the same as the spacing of the apertures from the side edges 4.

With respect to the finger holes, the finger hole base lines 31 and 39 are about 1.5" from the centerline CL. The finger holes are trapezoidal in shape, and thus can be divided into a rectangular portion and a triangular portion. The apex 36 of the triangular portion (and hence of the trapezoidal finger hole) is approximately aligned with the centers of the apertures. The outboard corners 38 of the rectangular portion of the finger hole are approximately aligned with the outer ends of the slits 17*a* which are perpendicular to the centerline CL and the side edges.

The carrier 1 additionally includes two side flaps 41 and an end flap 43 which are hingedly connected to the top ply 3 along hinge lines 45 and 47, respectively. The side flaps extend along the side edges 4 of the carrier, and the end flap extends along the end edge 6 opposite the hinge 11. The side flaps 41 extend parallel to the machine direction MD of the paperboard from which the carrier is made. When the carrier 1 is folded from the blank 7, the inner surfaces of the top and bottom ply are glued together. Additionally, the glue is applied to the side flaps 41 and the end flaps 43 so that the side and end flaps will be glued to the under side of the bottom ply 5.

The side flaps 41 reinforce the carrier along its machine direction to help prevent bending of the carrier along an axis perpendicular to the machine direction MD. The finger tabs 37, when pushed down through the bottom ply finger holes 31, also help to reinforce the carrier 1 to prevent bending of the carrier along an axis perpendicular to the machine direction MD.

Figure 1:
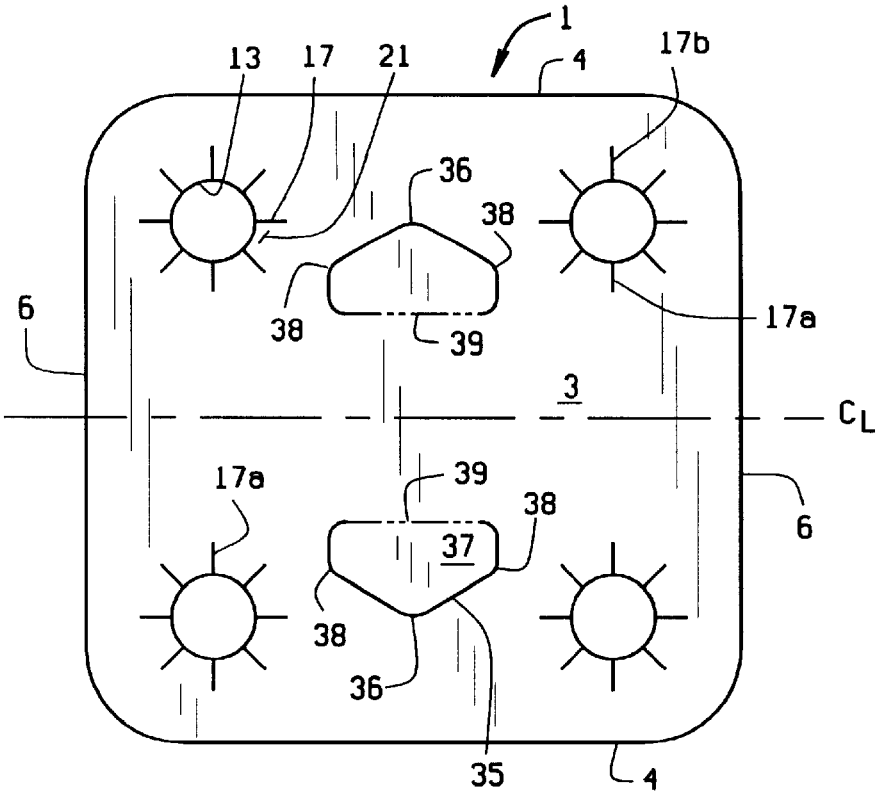
FIG. 1 is a top plan view of a carrier of the present invention.
Figure 4:
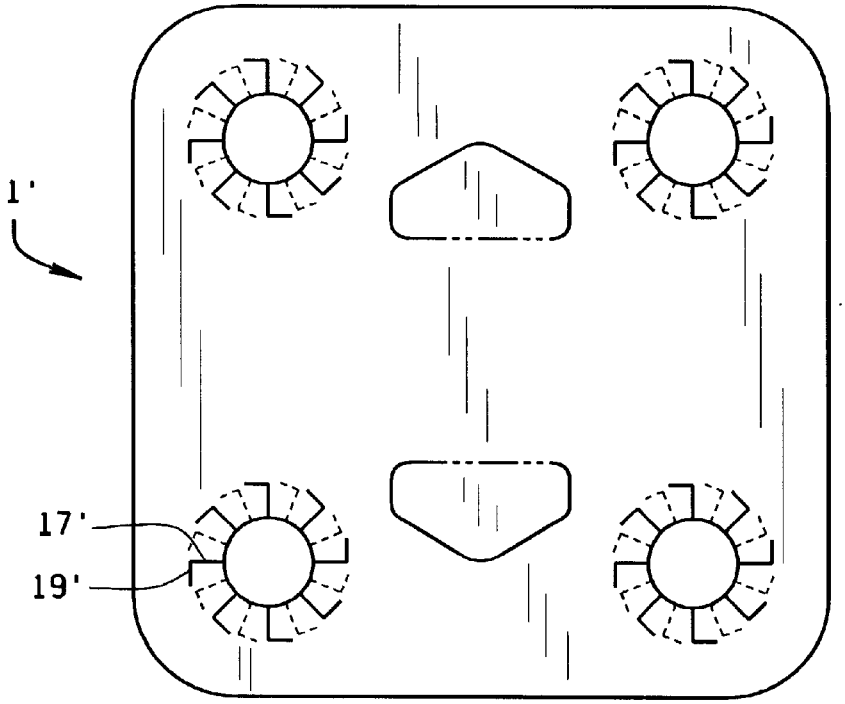
FIG. 4 is a plan view of the carrier with an alternative tab arrangement.

An alternative tab design is shown in the carrier 1' of FIG. 4. The tabs of the carrier 1' are defined by first slits 17' extending from the apertures in the carrier. Second slits 19' extend from the outer ends of the slits 17' and are generally perpendicular to the slits 17'. The slits 17' and 19' thus generally define an L-shaped slit. The slit 19' extends approximately ½ the base of the tab. As seen in phantom, the tabs in the bottom ply are offset from the tabs in the top ply. Thus, the outer ends of the slits 19' in the bottom ply are approximately aligned with the outer ends of the slits 17' in the top ply. Similarly, the outer end of the slits 19' in the top ply are approximately aligned with the outer ends of the slits 17' in the bottom ply. The use of the L-shaped tab-defining slits produces a tab in which the tab's bottle retaining force is easier to overcome, so that the bottle held in the carrier can be removed more easily than it could if the carrier had only radial slits, as shown in FIG. 1.

Figure 5A:
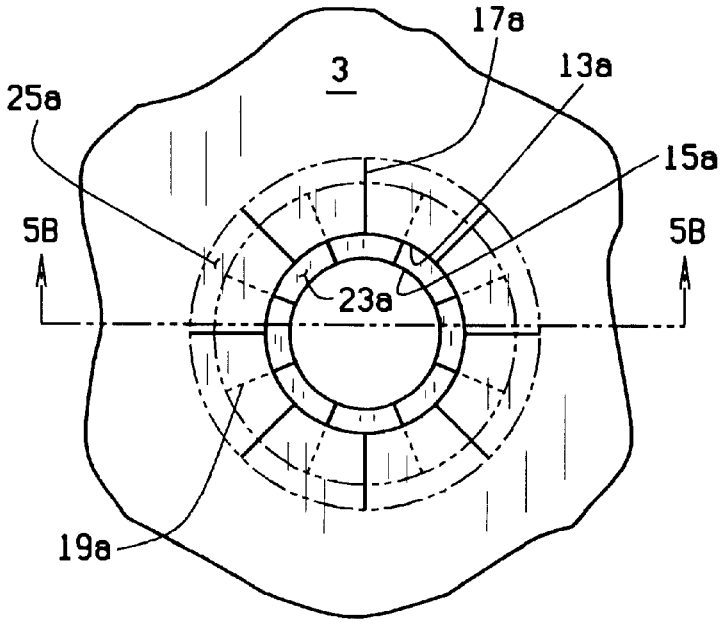
FIG. 5A is a plan view of the carrier with another alternative tab arrangement, the base lines of the tabs of the top and bottom plies being shown in phantom.
Figure 5B:
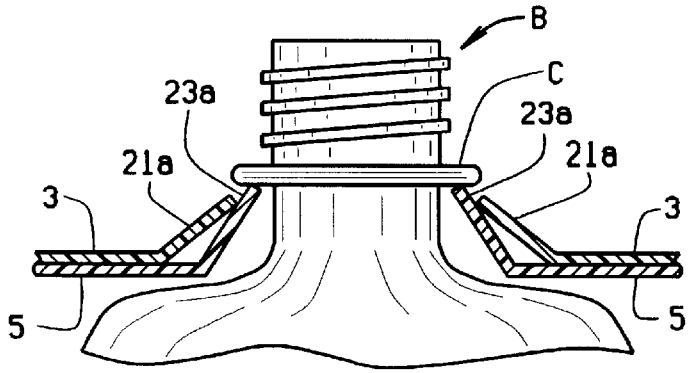
FIG. 5B is a cross-sectional view of the carrier taken through line 5B—5B of FIG. 5A, and showing a bottle in the carrier.

Turning to FIGS. 5A and 5B, the carrier top and bottom ply tabs 21*a* and 23*a* are shown to have different base diameters. The circles defined by the tab bases are shown in phantom in FIG. 5A. Although an embossment or slit could be provided at the base lines to help define the bending point of the tabs, such an embossment or slit is not necessary. The base diameter of the bottom ply tabs 23*a* is smaller than the base diameter of the top ply tabs 21*a*. When such a tab arrangement is used, I have found that the bottom ply tab 23*a* becomes the primary weight bearing tab and engages the underside of the chime C of the bottle B. The top ply tab 21*a* intersects the bottom ply tab 23*a* between the base and end of the bottom ply tab, as shown in FIG. 5B, such that the tabs 21*a*, 23*a*, and the carrier define a triangle. In this fashion, the top ply tabs 21*a* apply a radially inward force which holds the tabs 23*a* in place under the bottle chime, to reinforce the weight bearing bottom ply tab.

Figure 6A:
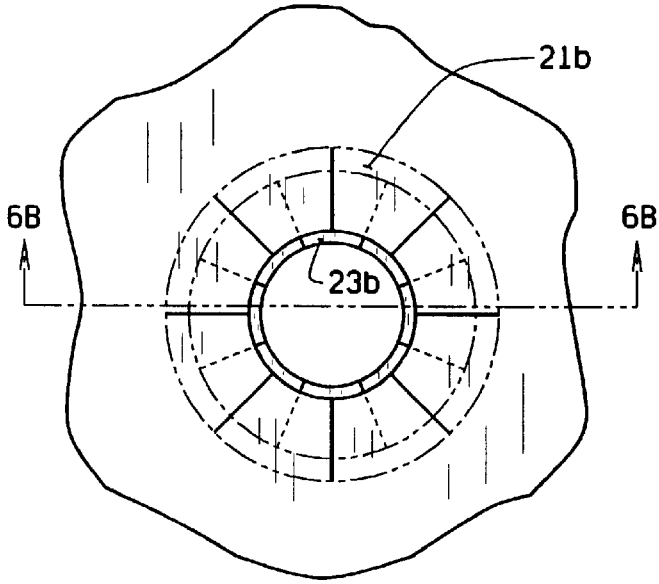
FIG. 6A is a plan view of the carrier with second alternative tab arrangement, the base lines of the tabs of the top and bottom plies being shown in phantom.
Figure 6B:
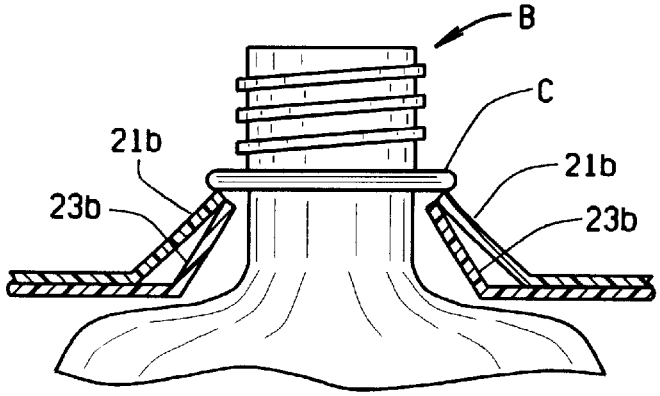
FIG. 6B is a cross-sectional view of the carrier taken through line 6B—6B of FIG. 6A, and showing a bottle in the carrier.

In FIGS. 6A and 6B, a variation is shown in which the length of the configuration of the top ply tabs 21*b* are altered so that the inner ends of the top ply tabs are closer to the inner ends of the bottom ply tabs 23*b*. This will allow the inner ends of the tabs to meet, and form a triangle, as seen in FIG. 6B in which the inner ends of both the top and bottom ply tabs engage the chime C of the bottle B. In this instance, both the top and bottom ply tabs are weight bearing tabs. The top ply aperture and top ply tab configuration can be altered by increasing the length of the top ply tabs while leaving the tab base diameter the same as in FIG. 5A, or alternatively, by decreasing the tab base diameter while leaving the tab length the same. The second alternative is preferable.

As various changes could be made in the above constructions without departing from the scope of the invention as set forth it the appended claims, it is intended that all matter contained in the above description or shown in the accompanying drawings shall be interpreted as illustrative and not in a limiting sense. For example, the finger holes could be rectangular or oval, if desired. If the finger hole were rectangular, the imaginary line extending between the slits 17*a* would extend adjacent the finger hole, rather than through the finger hole. Although the carrier is shown as a four-pack, the carrier could also be configured to be a six-pack, eight-pack, ten-pack, etc. These examples are merely illustrative.

What is claimed is:

1. A planar carrier for carrying a plurality of containers of liquid; said planar carrier having a center line; a pair of side edges, and a pair of end edges; said carrier being made from a one piece paperboard blank having a machine direction; the carrier comprising:

a top ply and a bottom ply joined together along a hinge line, said hinge line extending perpendicular to the machine direction and defining one of said carrier end edges; said top ply and bottom ply each including a plurality of aligned container receiving apertures formed in a 2×n array, wherein n is an integer greater than 1 such that there are two columns of container receiving apertures; a plurality of slits extending radially from the each aperture in at least one of said top and bottom plies to define container engaging tabs to support a container in said carrier when said carrier is lifted;

at least one finger hole in the bottom ply; the finger hole having an elongate edge, said elongate edge being parallel to the machine direction of the paper board;

at least one finger hole in the top ply; said top ply finger hole including a tab sized and shaped to extend down through said bottom ply finger hole when said carrier is lifted; said finger hole tab being hingedly connected to said top ply along a hinge line generally parallel to the machine direction of said paperboard;

wherein said container receiving apertures are outboard of the center line of the carrier; and wherein said at least one finger hole is positioned outboard of the carrier centerline such that an line extending from radial outer ends of said tab defining slits pass adjacent to or through said finger hole.

2. The carrier of claim 1 wherein the centers of said container receiving apertures are positioned at least 50% of the way from the centerline of the carrier to the side edge of the carrier.

3. The carrier of claim 1 including a side flap extending along at least a portion of said carrier side edges; said side flap being hingedly connected to one of said top and bottom plies; and adhered to the other of said top and bottom plies; said side flap extending in a direction generally parallel to the machine direction of the paperboard.

4. The carrier of claim 1 including an end flap extending along an end edge of said carrier; said end flap being hingedly connected to one of said top and bottom plies; and adhered to the other of said top and bottom plies; said end flap extending in a direction generally perpendicular to the machine direction of the paperboard.

5. The carrier of claim 1 wherein said tab defining slits include a first slit extending outwardly from said apertures and a second slit extending from an end of said first slit.

6. The carrier of claim 5 wherein said tab defining slit is generally L-shaped.

7. The carrier of claim 1 including tab defining slits around the apertures of the other of said top and bottom plies such that the apertures of each of said top and bottom plies are surrounded by tabs; the top ply tabs defining a tab base and said bottom ply tabs defining a tab base; the tab base of said top ply tabs having a diameter larger than the diameter of said bottom ply tab base; such that, when a container is received in the carrier aperture, the top and bottom ply tabs define, in conjunction with the plane of the carrier, a triangle.

8. The carrier of claim 7 wherein said top ply tabs engage said bottom ply tabs between the base and an inner end of said bottom ply tabs.

9. The carrier of claim 7 wherein said top ply tabs engage said bottom ply tabs substantially at the inner ends of said bottom ply tabs.

10. The carrier of claim 7 wherein the top ply tabs have a length equal to a length of the bottom ply tabs; whereby, the top ply aperture is equal to or larger in diameter than the bottom ply aperture.

11. A carrier for carrying a plurality of containers of liquid, said carrier including a panel having a top ply and a bottom ply; said top ply and bottom ply each including a plurality of aligned container receiving apertures; a plurality of slits extending radially from the each apertures in said top and bottom plies to define tabs to support a container in said carrier when said carrier is lifted; the top ply tabs defining a tab base and said bottom ply tabs defining a tab base; the tab base of said top ply tabs having a diameter larger than the diameter of said bottom ply tab base; such that, when a container is received in the carrier, the top and bottom ply tabs define, in conjunction with a plane of the carrier, a triangle.

12. The carrier of claim 11 wherein, when a bottle is inserted in said carrier apertures, said top ply tabs engage said bottom ply tabs between the base and inner ends of said bottom ply tabs.

13. The carrier of claim 11 wherein, when a bottle is inserted in said carrier apertures, said top ply tabs engage said bottom ply tabs substantially at the inner ends of said bottom ply tabs.

14. The carrier of claim 11 wherein the top ply tabs have a length equal to a length of the bottom ply tabs; whereby, the top ply aperture is larger in diameter than the bottom ply aperture.

* * * * *